US007314440B2

(12) United States Patent
Boppel et al.

(10) Patent No.: US 7,314,440 B2
(45) Date of Patent: Jan. 1, 2008

(54) FORMER FOR A STRIP-PRODUCING OR STRIP-PROCESSING MACHINE

(75) Inventors: Johannes Boppel, Frankenthal (DE); Peter Wilhelm Kurt Leidig, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 75 days.

(21) Appl. No.: 10/531,670

(22) PCT Filed: Oct. 20, 2003

(86) PCT No.: PCT/DE03/03470

§ 371 (c)(1),
(2), (4) Date: Apr. 18, 2005

(87) PCT Pub. No.: WO2004/037698

PCT Pub. Date: May 6, 2004

(65) Prior Publication Data

US 2006/0025295 A1 Feb. 2, 2006

(30) Foreign Application Priority Data

Oct. 19, 2002 (DE) ..... 102 48 820
Feb. 19, 2003 (DE) ..... 103 07 089
May 20, 2003 (DE) ..... 103 22 651
Jul. 11, 2003 (DE) ..... 103 31 469

(51) Int. Cl.
*B31B 21/26* (2006.01)

(52) U.S. Cl. ..... 493/254; 493/450; 493/418

(58) Field of Classification Search ..... 493/254, 493/431, 450, 418; 242/615.12, 615.21
See application file for complete search history.

(56) References Cited

U.S. PATENT DOCUMENTS 3,111,310 A * 11/1963 Dutro et al. ..... 493/439
3,245,334 A 4/1966 Long
3,518,940 A 7/1970 Stroud et al.
3,744,693 A 7/1973 Greiner
4,176,775 A 12/1979 Brendemuehl
4,321,051 A 3/1982 Hajek et al.
4,887,973 A * 12/1989 Susini et al. ..... 493/213
5,423,468 A 6/1995 Liedtke
5,467,179 A 11/1995 Boeck et al.
5,779,616 A 7/1998 Hintermeier et al.
5,947,026 A * 9/1999 Murray et al. ..... 101/416.1
5,947,411 A * 9/1999 Burke et al. ..... 242/615.12
6,210,309 B1 * 4/2001 Smithe et al. ..... 493/438
6,619,583 B2 9/2003 Henry et al.
6,635,111 B1 10/2003 Holtmann et al.
6,773,387 B2 * 8/2004 Harnish ..... 493/418
2004/0134321 A1 7/2004 Weis

FOREIGN PATENT DOCUMENTS

DE 1142 878 1/1963

(Continued)

*Primary Examiner*—Sameh H. Tawfik
(74) *Attorney, Agent, or Firm*—Jones, Tullar & Cooper, PC

(57) ABSTRACT

A former is provided for a web-producing or a web-processing machine. The former is structured with a porous material through which a fluid can pass. The porous material is positioned or located on at least one region of the former that is cooperating with a strip of material to be folded.

20 Claims, 6 Drawing Sheets

FOREIGN PATENT DOCUMENTS

| | | | |
|---|---|---|---|
| DE | 1 761 595 | | 9/1971 |
| DE | 2 026 355 | | 11/1971 |
| DE | 29 21 757 | | 12/1980 |
| DE | 43 35 473 | | 4/1995 |
| DE | 295 01 537.3 | | 4/1995 |
| DE | 44 35 528 | A1 | 4/1996 |
| DE | 198 29 094 | A1 | 1/2000 |
| DE | 198 29 095 | A1 | 1/2000 |
| DE | 198 54 053 | A1 | 5/2000 |
| DE | 101 12 416 | | 3/2001 |
| DE | 100 31 814 | A1 | 1/2002 |
| DE | 199 02 936 | | 6/2002 |
| DE | 198 29 094 | C2 | 10/2002 |
| EP | 0 364 392 | | 4/1990 |
| GB | 946816 | | 1/1964 |

* cited by examiner

FORMER FOR A STRIP-PRODUCING OR STRIP-PROCESSING MACHINE

CROSS-REFERENCE TO RELATED APPLICATIONS

This patent application is the U.S. National Phase, under 35 U.S.C. 371, of PCT/DE2003/003470, filed Oct. 20, 2003; published as WO 2004/037698 A1 on May 6, 2004 and claiming priority to DE 102 48 820.7, filed Oct. 19, 2002; to DE 1030709.3, filed Feb. 19, 2003; to DE 103 22 651.6, filed May 20, 2003 and to DE 103 31 469.5, filed Jul. 11, 2003, the disclosures of which are expressly incorporated herein by reference.

FIELD OF THE INVENTION

The present invention is directed to a former of a web-producing or of a web-processing machine. The former has a web-engaging surface, typically formed by two converging legs that includes a porous material through which fluid can flow.

BACKGROUND OF THE INVENTION

A former is known from DE 44 35 528 A1, which former has air outlet openings on its side and which former is acting together with a web. By arranging openings in a base plate and in a counter-plate, which counter-plate can be displaced in respect to the base plate, the effective air outlet openings can be varied from a maximum size, providing full coverage to zero, providing no coverage.

U.S. Pat. No. 5,423,468 A1 shows a guide element having an inner body with bores and with an outer body of a porous, air-permeable material. The bores in the inner body are only provided in the area which is expected to be engaged, or looped, by the web.

A sheet-conducting installation is known from DE 198 54 053 A1. Blown air flows through bores, slits, porous material or nozzles in a guide area of a guide element and in this way conducts the sheet in a contactless manner.

DE 29 21 757 A1 discloses a former, which has several compressed air supply chambers for blow-air openings in the area of its legs. Optimal air metering can be achieved by the position, size and shape of the openings.

The use of porous materials in the surface area of a spreading device in a paper-making machine is disclosed in EP 0 364 392 A2.

DE 295 01 537 U1 shows a sheet guide device. Air supply boxes with different configurations of air nozzles, with respect to size, arrangement and structure, for different requirements made on a holding or blowing force on the path of a web, are proposed.

A former disclosed in DE 100 31 814 A1 has blow-air openings in a leg, as well as in a nose area. A volume of the air flowing off underneath the web can be varied by locking element.

DE-A-11 42 878 also discloses a former with blow-air openings in a leg, as well as in a nose area. Here, the leg and nose areas can be charged with fluid at different pressures.

SUMMARY OF THE INVENTION

The object of the present invention is directed to providing formers for a web-producing or web-processing machine.

In accordance with the present invention, this object is attained by the provision of a former of a web-producing or of a web-processing machine, which may have two angularly converging leg areas, an having a surface area that acts together with a web to be formed. The surface area has a plurality of openings for the exit of fluid under pressure. These openings can be micro-porous openings in a porous material and can have an unchangeable diameter of less than 500 μm.

The advantages to be gained by the present invention consist, in particular, in that a former is provided which operates at a very low friction. By the provision of an air cushion formed by micro-openings, a large degree of homogeneity is produced throughout the extent of the air cushion simultaneously along with small air losses in areas of the surface not contacted by the web.

By the use of air outlet openings with diameters in the millimeter range, forces can be applied point-by-point to the material, in the manner of an impulse of a jet, by the use of which, the latter can be kept away from the respective component. By the distribution of micro-openings with a high hole density, a broad support and, as a matter of priority, the effect of a formed air cushion is applied. The cross section of bores used in the past lay, for example, in a range between 1 and 3 mm. The cross section of the micro-openings in accordance with the present invention is smaller by at least the power of ten. Substantially different effects arise from this. For example, the distance between the surface of the former with the openings and the web of material, such as, for example, a web or a strand, can be reduced. The flow volume of the flow can drop considerably. Because of this, flow losses, which could possibly occur outside of the areas which act together with the web, can clearly be reduced.

In contrast to prior components, having openings, or bores, with opening cross sections in the millimeter range and with a hole spacing distance of several millimeters, a greatly more homogeneous surface is provided with the formation of micro-openings on the surface. Here, micro-openings are understood to be openings in the surface of the component which have a diameter of less than or equal to 500 μm, and advantageously have a diameter less than or equal to 300 μm, and, in particular, have a diameter less than or equal to 150 μm. A "hole density" of the surface provided with micro-openings is at least one micro-opening per 5 $mm^2$, which equals to a hole density of $0.20/mm^2$ and, advantageously at least one micro-opening per 3.6 $mm^2$, which equals to a hole density of $0.28/mm^2$.

The micro-openings can advantageously be configured as open pores terminating at the surface of a porous, and, in particular, at the surface of a micro-porous, air-permeable material, or as openings of penetrating bores of small diameter, which extend through the wall of a supply chamber toward the exterior.

In order to achieve a uniform distribution of air exiting from the surface area of the former, in the case of employing micro-porous material, and without requiring, at the same time, large layer thicknesses of the micro-porous material with high flow resistance, it is useful for the former to have a rigid air-permeable support in the appropriate area, to which support the micro-porous material has been applied as an outer layer. Such a support can be charged with compressed air, which compressed air flows out of the support, and then through the micro-porous layer, and in this way forms an air cushion on the surface of the component such as the former.

The support itself can be porous and may have a better air permeability than the micro-porous material. It can be formed of a flat material or of a shaped material, which material encloses a hollow space and which material is provided with air outlet openings. Combinations of these alternatives can also be considered.

To achieve a uniform air distribution, it is moreover desirable that the thickness of the porous layer correspond, at least, to a distance between adjoining openings in the porous layer.

In case of the use of micro-bores, an embodiment of the present invention is advantageous, wherein a side of the former which faces the web and which has the micro-openings is embodied as an insert, or as several inserts placed in a support. In a further development of the present invention, the insert or inserts can be releasably or, if desired, exchangeably connected with the support. In this way, cleaning, or an exchange of the inserts for inserts with different micro-perforations, for adaptation of the former to different materials, to different web tensions, to a different number of layers in the strand or to different partial web widths is possible.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
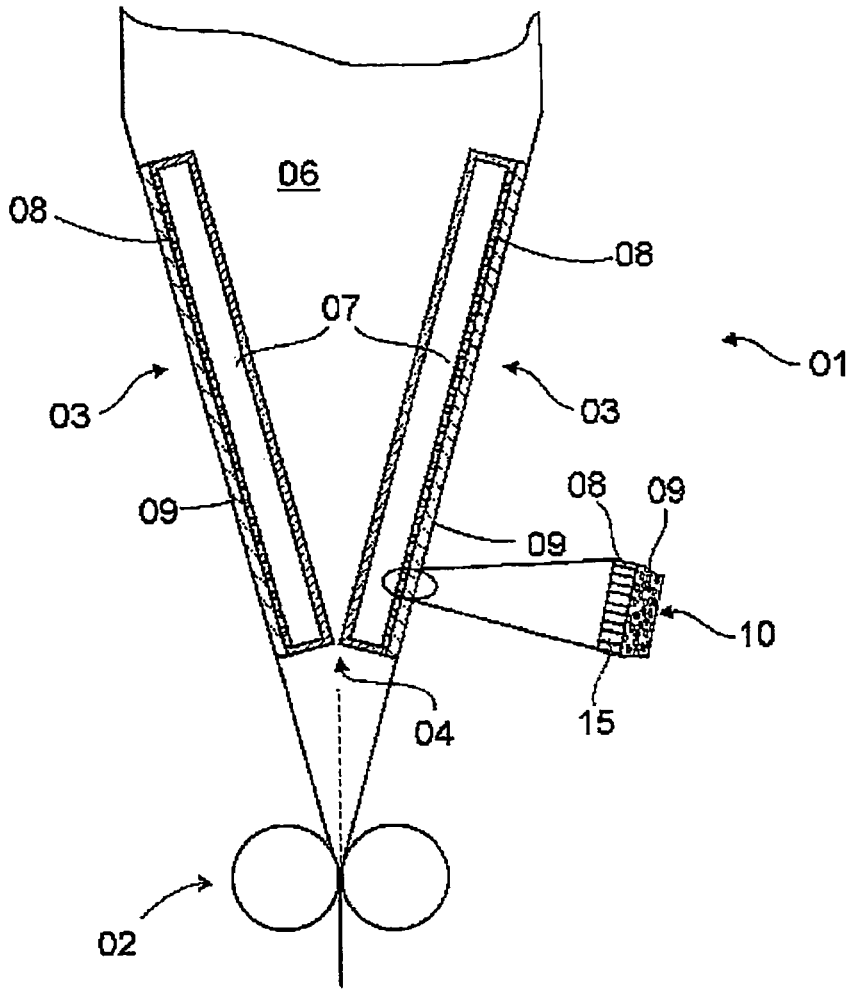
FIG. 1, a schematic cross-section through a first preferred embodiment of the former with porous material in accordance with the present invention, in FIG. 2, a cross-section taken perpendicularly with respect to FIG. 1, and through a leg area of the former, in FIG. 3, a schematic cross-section through a second preferred embodiment of the former with porous material, in FIG. 4, a schematic cross-section through a third preferred embodiment of the former with porous material, in FIG. 5, a schematic front elevation view, of a support body of a former in accordance with FIG. 3 or 4, in FIG. 6, a schematic cross-section through a first embodiment of the former with micro-bores in accordance with the present invention, in FIG. 7, a cross-section taken perpendicularly with respect to FIG. 6, and through a leg area of the former, in FIG. 8, a schematic cross-section through a second preferred embodiment of the former with micro-bores, in FIG. 9, a schematic cross-section through a third preferred embodiment of the former with micro-bores, in FIG. 10, a schematic cross-sectional view, from above, of a former with a separate nose section, and in FIG. 11, a schematic front elevation view on a folding device having micro-openings.

A schematic cross-section through a former 01, through which a web 06, such as, for example, a web 06 of material or a web 06 of material to be imprinted, runs is shown in FIG. 1. The former 01 has two former leg areas 03, which two former leg areas 03 come together at an acute angle. Former 01 also has a nose section 04, as well as a traction roller pair 02 which are located at the vertex of the angle formed by the outsides of the two former leg areas 03. The web 06 is fed to the former 01 from above, parallel with the drawing plane. In the course of the passage of the web 06 through the former 01, the lateral edges of the web 06 of material are flipped or turned out of the drawing plane, so that a web 06 is formed which has been folded once and which passes through the traction roller pair 02 in an orientation transversely with relation to the drawing plane. This process also applies in the same way if, in place of a web 06, a partial web or a strand of webs, or several partial webs, lying on top of each other, is or are conducted over the former 01.

On an outside of at least one section of its leg area 03, or its leg areas 03, which leg area 03 or leg areas 03 act together with the web 06, the former 01 has opening 10, which are embodied as micro-openings 10. At least in this area, the former has a hollow inner space 07, or a hollow space 07, which space 07 can be charged with compressed air through a feed line, which is not specifically represented.

A fluid, such as, for example, a liquid, a gas or a mixture, and in particular air, which fluid is under higher pressure than the surroundings, flows through the micro-openings 10 from the hollow space 07, embodied, for example, as the chamber 07, and in particular as the pressure chamber 07, during operation of the former. An appropriate feed line for conducting compressed air into the hollow space 07 is not specifically represented in the drawings.

In a first preferred embodiment of the present invention, the micro-openings 10 are embodied as open pores on the outer surface of a porous, and, in particular, a micro-porous, air-permeable material 09, such as, for example an open-pored sinter material 09, and in particular, a sinter metal. The pores of the air-permeable porous material 09 have a mean diameter, or mean size, of less than 150 μm, for example of 5 to 60 μm, in particular of 10 to 30 μm. The micro-porous, air-permeable material 09 is provided with an irregular amorphous structure.

At least in the area of the former 01 which is acting together with the web 06, the hollow space 07 can be made of a body of essentially only porous solid material, i.e. without any further load-bearing layers of appropriate thickness, closing the hollow space 07 off on this side of the former 01 facing the web 06. This substantially self-supporting body is then configured with a wall thickness of more than or equal to 2 mm, and in particular with a wall thickness of more than or equal to 3 mm. In this way, two tube-shaped bodies made of the porous material 09 could, for example, constitute the leg areas 03 of the former 01 and, if desired, a suitably shaped hollow body made of the porous material 09 could form the former nose section 04, called the nose 04 for short. Furthermore, the entire former 01, including a former plate, can be embodied using the micro-porous layer 09.

To achieve a uniform distribution of the air exiting at the outer surface of the micro-porous material 09, without requiring, at the same time, large layer thicknesses of the micro-porous material 09, with a correspondingly high flow resistance, it is provided, in a first embodiment of the invention, as seen in FIG. 1, that, in its leg area 03, the former 01 has a solid support 08, and, in particular, has a support body 08, which is air-permeable at least in part and on which the micro-porous material 09 has been applied as a surface layer 09. Such a support body 08 can be charged with compressed air, which compressed air then flows out of the support body 08, through the micro-porous layer 09, and, in this way, forms an air cushion at the surface of the leg area 03 or the nose sections 04. In a particularly advantageous embodiment of the present invention, the porous material 09 is therefore not embodied as a supporting solid body, either with or without a frame structure, but instead is provided as a layer 09 on an underlying support body 08, which support body 08 has passages 15 or through-openings and which is made, in particular, of a metallic support material. A structure is understood to be inclusive of the "non-supporting" air-permeable layer 09, together with the support body 08, in contrast to, for example, the "self-supporting" layers which are known from the prior art. The layer 09 is supported, over its entire layer length and entire layer width, on a multitude of support points of the support body 08. For example, the support body 08 has, over its width and length which is active together with the layer 09, a plurality of non-connected passages 15, such as, for example, bores 15. This depicted embodiment is clearly different from an embodiment in which a porous material extending over the entire active width is configured to be self-supporting over this distance, and is only supported in the end area on a frame or support, and therefore must have an appropriate thickness.

The leg areas 03 of the former 01, which are embodied as web guide plates 03 in FIG. 1, are each constituted by a support 08, such as, for example, by a housing made of sheet metal, whose side facing the web 06 of material has a multitude of openings and which supports the micro-porous layer 09. An air flow, which flows from the inner chamber 07 through the micro-porous layer 09, forms an air cushion on the surface of the micro-porous, air-permeable layer 09, which air cushion prevents direct contact between the web guide plates 03 and the web 06 to be guided by them. Therefore, the web 06 passes through the former 01 smoothly and uniformly without the danger of becoming stuck and without any danger of damage being done to the web.

Figure 2:
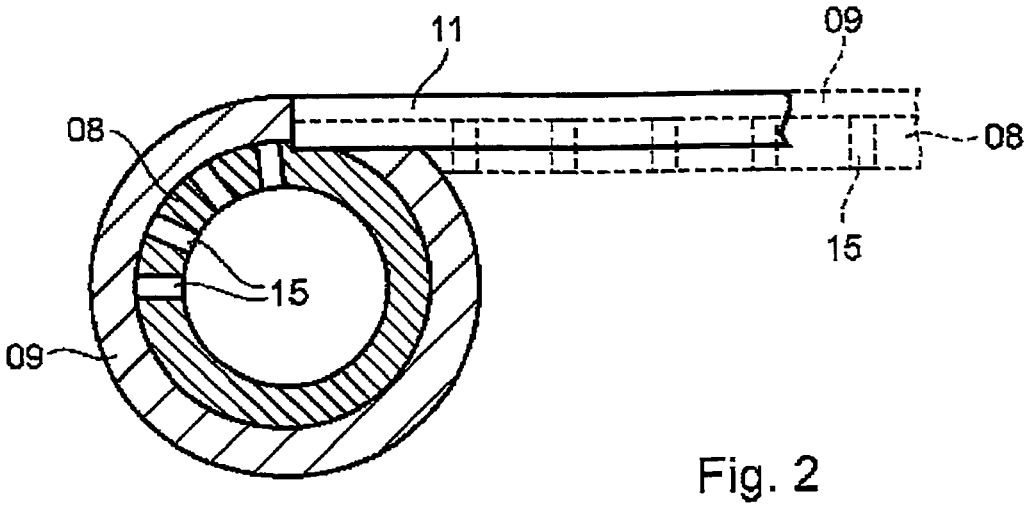

An embodiment of the present invention is particularly advantageous wherein, in the area of its converging cheeks, the former 01 is embodied with the passages 15 and with the micro-porous, air-permeable layer 09 at least in the bending area, i.e. in the area of the "edge" of the former 01 which changes the direction of the web. These support passages 15 and the overlying, micro-porous, air-permeable layer 09 can be arranged in the area of the cheeks, as well as in the edge area of the surface, so that it can pass around the folding edge. Advantageously, this folding edge is not made with a sharp edge, but instead has a curvature with a radius. A cross-section through a side of the former 01 in the leg area 03, and in accordance with an advantageous embodiment of the present invention is represented in FIG. 2. The "edge", which is effective for folding the web 06, is formed by a support 08 that is embodied as a tube 08, or as spar 08, which tube 08 has openings of the bores 15 located at least in a looped-around or contact area of the former 01 with the web 06 and which area is coated with the micro-porous layer 09. In principle, two such converging tubes 08, and having appropriate bracing for forming the former 01, are sufficient as a former 01. In the preferred embodiment, the former 01 has a cover 11, such as, for example, a former plate 11, or plate 11 for short, which extends between the two tubes or spars 08 which cover 11, as shown in FIG. 2, terminates flush with the effective surface of the tube or spar 08. However, in order to form a free space between the plate 11 and the tensioned web 06, the plate 11 could be arranged offset "toward the bottom" away from the web 06. This plate 11 can also be embodied as a whole, or in parts with openings 10, 15 and, if desired, with the micro-porous, air-permeable layer 09, against which compressed air is blown from "below" out of a hollow space, which is only indicated by dashed lines.

In an embodiment of the present invention, which is not specifically represented, the former 01 can also be configured to be divided. This means that each of the two tubes or spars 08, together with "half" a former plate 11, form a symmetrical half of the upper former area. A common nose section 04 is assigned to the two former halves. What has been discussed above, in connection with the other embodiments regarding the spars 08 and the nose section 04, then also applies.

Figure 3:
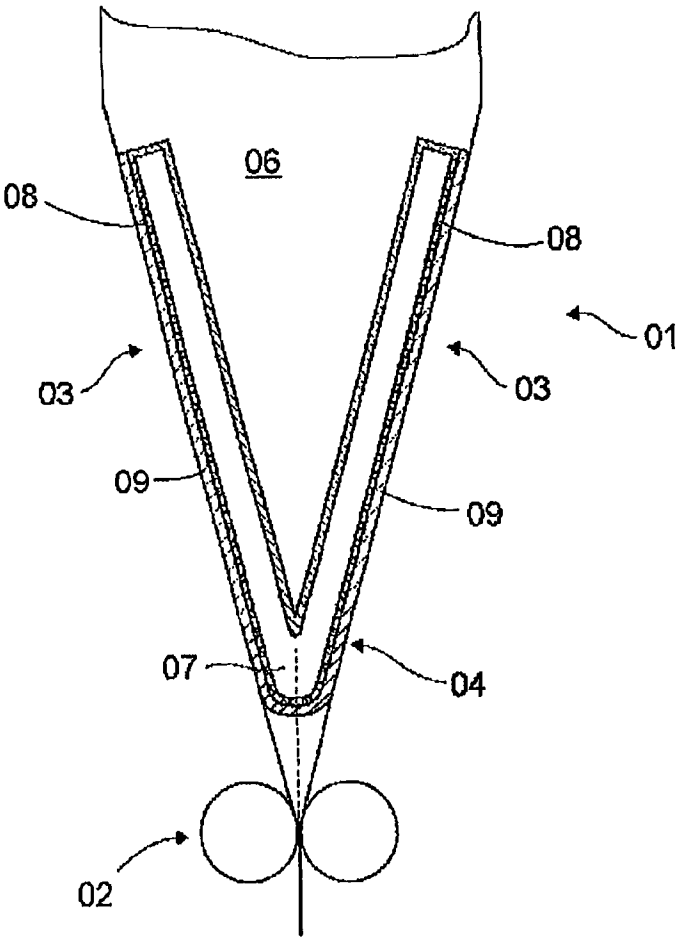

FIG. 3 shows an embodiment of the present invention in which the areas on which compressed air is blown and which areas are provided with the micro-porous, air permeable layer 09 and with bores 15 come together to form a common hollow space 07 in the nose section 04. In the nose section 04, bores 15, as well as the layer 09, are arranged, at least in the area of the surfaces which are acting together with the web 06.

In a further development of the representation of the present invention which is depicted in FIG. 3, it is possible, for example with the provision a uniform coating, to embody the hollow space 07' in the nose section 04 separately from the hollow space 07 of the leg areas 03 and to provide the nose section hollow space 07 with its own supply of compressed air. In this case, the nose section 04 and the leg area 03 can be charged with different pressures, which pressure may be, for example, higher in the nose section 04.

The choice of material to use, the dimensions and the charging with pressure have been selected in such a way that 1 to 20 standard cubic meters per $m^2$, and in particular 2 to 15 standard cubic meters per $m^2$ exit from the air outlet surface of the sinter material 09 per hour. An air output of 3 to 7 standard cubic meters per $m^2$ is particularly advantageous.

The sinter surface is advantageously charged with a fluid at an excess pressure of at least 1 bar, and in particular at a pressure of more than 4 bar, from the hollow space 07. A charge of the sinter surface with excess pressure of 5 to 7 bar is particularly advantageous.

Figure 4:
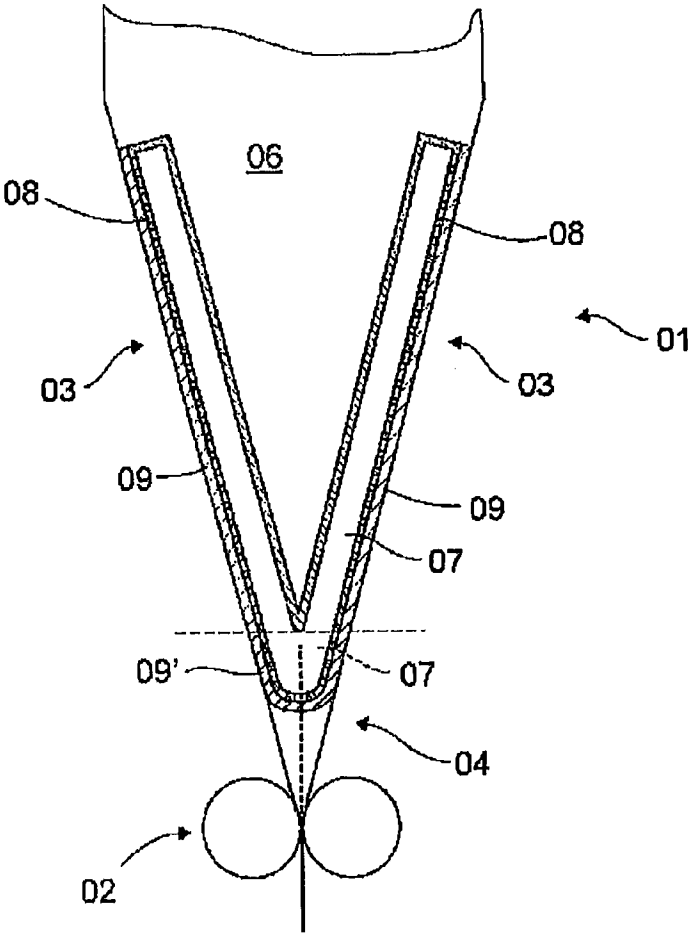

An embodiment of the former 01 is represented in FIG. 4, wherein micro-porous, air-permeable materials 09, 09' of different properties and/or of differing layer thickness are used for the layer 09 in different areas of the former 01. The layer 09' in the nose section 04 of the former 01 is embodied in such a way that, for example, the exiting air flow per unit of area is greater in the nose section 04 than it is in the cheek, or in the leg area 03 of the former 01. Therefore, the nose section 04 has a layer 09' of the micro-porous, air-permeable material, whose mean pore size is greater. The proportion of open external surface per unit of area is greater and/or the layer thickness is less than with the material of the layer 09 in the leg area 03. Therefore the air-permeable material 09 of the leg area 03 has, for example, pores of a mean size of 10 to 30 μm, and the nose section 04 has, for example, pores of a mean size of 25 to 60 μm. As represented in FIG. 4, the area of the different layers 09, 09' can be provided with compressed air via a common chamber 07, or a common hollow space 07. Separate chambers 07 can also be provided for this purpose, which separate chambers can then possibly be charged with compressed air of different pressure. As a result of this variation of the pore size and/or pressure, the air output in the leg area 03 lies, for example, between 2 to 15 standard cubic meters per $m^2$, and the air output in the nose section 04 lies between 7 and 20 standard cubic meters per $m^2$, with the condition that the latter air output be greater than the former.

Figure 5:
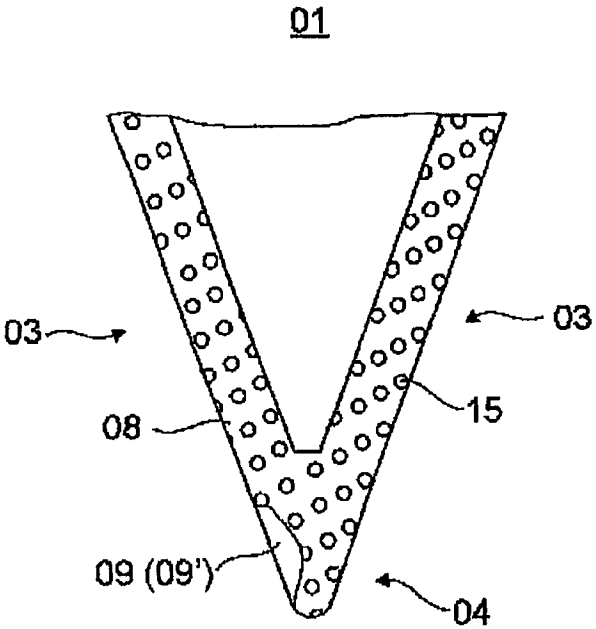

FIG. 5 schematically represents a front elevation view, of the former 01 with converging tubes or spars 08 and taken in the nose section 04. However, the representation of FIG. 5 shows the former 01 without the layer 09, or the layers 09, 09' of different layer material, so that the sketched-in openings of the passages 15 are visible in FIG. 5 which passages extend radially outwardly in the tubes or spars 08, as seen in FIG. 2.

In the preferred embodiments of the present invention, as represented, the support material 08 substantially absorbs the weight, torsion, bending and/or shearing forces of the component, because of which an appropriate wall thickness, for example greater than 3 mm, and in particular greater than 5 mm, of the support body 08 and/or an appropriately reinforced construction have been selected. The porous material 09 outside of the passage 15 has a layer thickness which, for example, is less than 1 mm. A layer thickness of between 0.05 mm and 0.3 mm is particularly advantageous.

A proportion of the open face of the porous material 09, in the area of the effective outer surface of the porous material 09, here called the degree of opening, lies between 3% and 30%, and preferably lies between 10% and 25%. To achieve an even distribution of air, it is furthermore desirable for the thickness of the layer 09 to correspond at least to the distance between adjoining openings of the bores 15 of the support body 08.

The wall thickness of the support body 08, at least in the area supporting the micro-porous. Air-permeable layer 09, 09', is greater than 3 mm, and in particular is greater than 5 mm.

The support body 08 can itself also be made of a porous material, but with a better air permeability, such as, for example, with a greater pore size than that of the micro-porous material of the layer 09. In this case, the openings of the support body 08 are constituted by open pores in the area of the surface, and the passages 15 are formed by channels which are incidentally formed in the interior because of the porosity. However, the support body 08 can also be constituted by any arbitrary flat material enclosing the hollow space 07 and which is provided with passages 15, or by shaped material. Combinations of these alternative can also be considered.

The interior cross section of a feed line, which is not specifically represented, for supplying the compressed air to the former 01 is less than 100 $mm^2$, it preferably lies between 10 and 60 $mm^2$.

Figure 6:
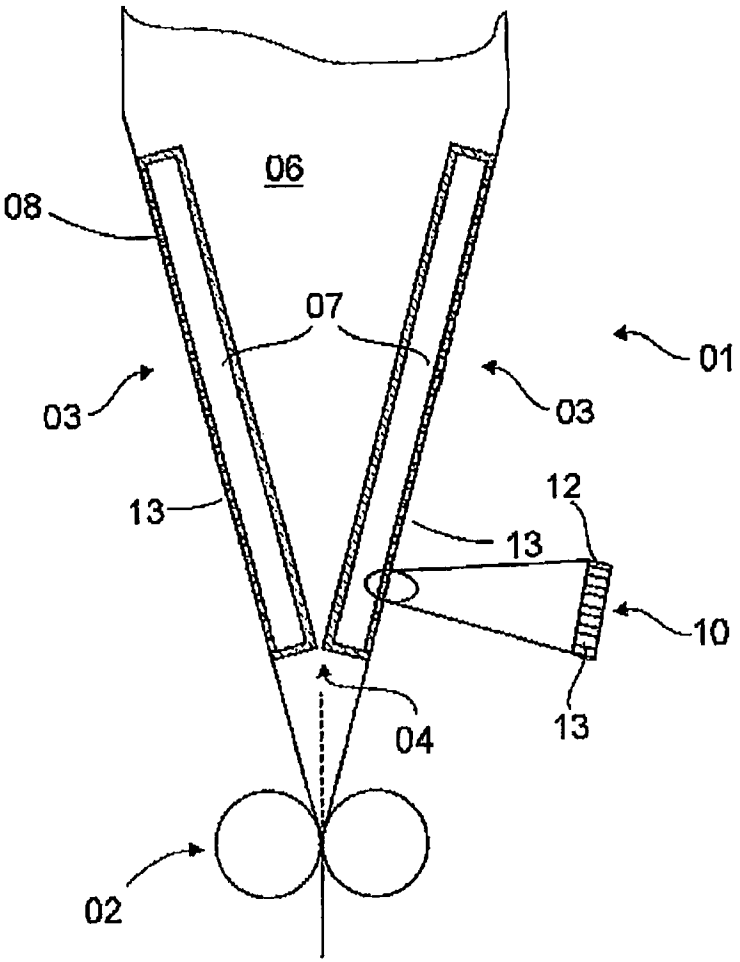
Figure 7:
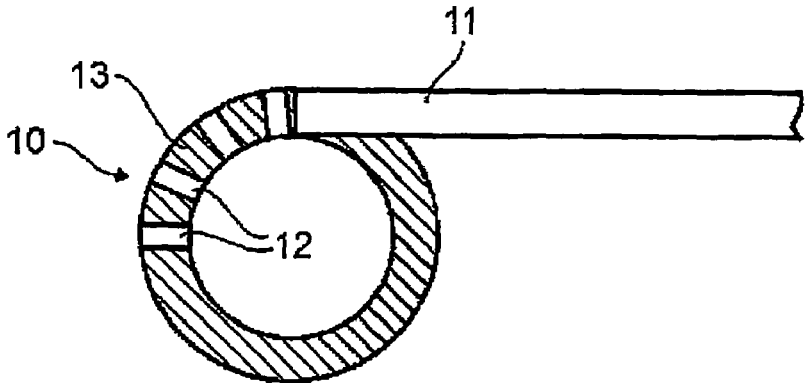

In a second embodiment of a former, as depicted in FIGS. 6 to 9, the micro-openings 10 are configured as openings of penetrating bores 12, in particular micro-bores 12, which bores 12 extend outward through a wall 13, such as, for example, a chamber wall 13, bordering the hollow chamber 07, which is, for example, configured as a pressure chamber 07. In the leg area 03 of the former 01, the chamber wall 13 can be advantageously configured as a tube 13 or as a spar 13, as seen in FIG. 7. The bores 12 have, for example, a diameter, at least in the area of the micro-openings 10 of less than or equal to 500 μm, advantageously of less than or equal to 300 μm, and in particular of between 60 and 150 μm. The degree of opening lies, for example, between 3% to 25%, and in particular between 5% to 15% of the surface area. A hole density is at least ⅕ $mm^2$, and in particular is at least from 1/$mm^2$ up to 4/$mm^2$. Therefore, the wall 13 has a micro-perforation, at least in a leg area 03. In an advantageous manner, the micro-perforation, in a manner the same as the passages 15 and layer 09 in the first preferred embodiment, extends at least through the leg area 03 and a nose section 04.

A wall thickness of the chamber wall 13 containing the bores 12 which wall thickness, inter alia, affects the flow resistance, lies between 0.2 to 0.3 mm, advantageously lies between 0.2 to 1.5 mm, and in particular lies between 0.3 to 0.8 mm. A reinforcing structure, which is not specifically represented, such as, for example, a support extending in the longitudinal direction of the spars 13, and in particular such as a metal support, can be arranged in the hollow space 07, on which the chamber wall 13 is supported at least in part or at points.

Modified embodiments of the embodiments depicted in FIGS. 1 to 4 are represented in FIGS. 6 to 9, in which representations the wall 13 with the micro-openings 12 takes the place of the support 08 and the layer 09, 09'.

In FIG. 6, the leg areas 03 have the micro-bores 12 in the chamber wall 13 facing the web 06, at least in their folding edge areas.

FIG. 7 shows the embodiment of the chamber wall 13 as a tube 13, which tube or spar 13 has micro-perforations, or micro-bores 12, at least in the area of the folding edges.

Figure 8:
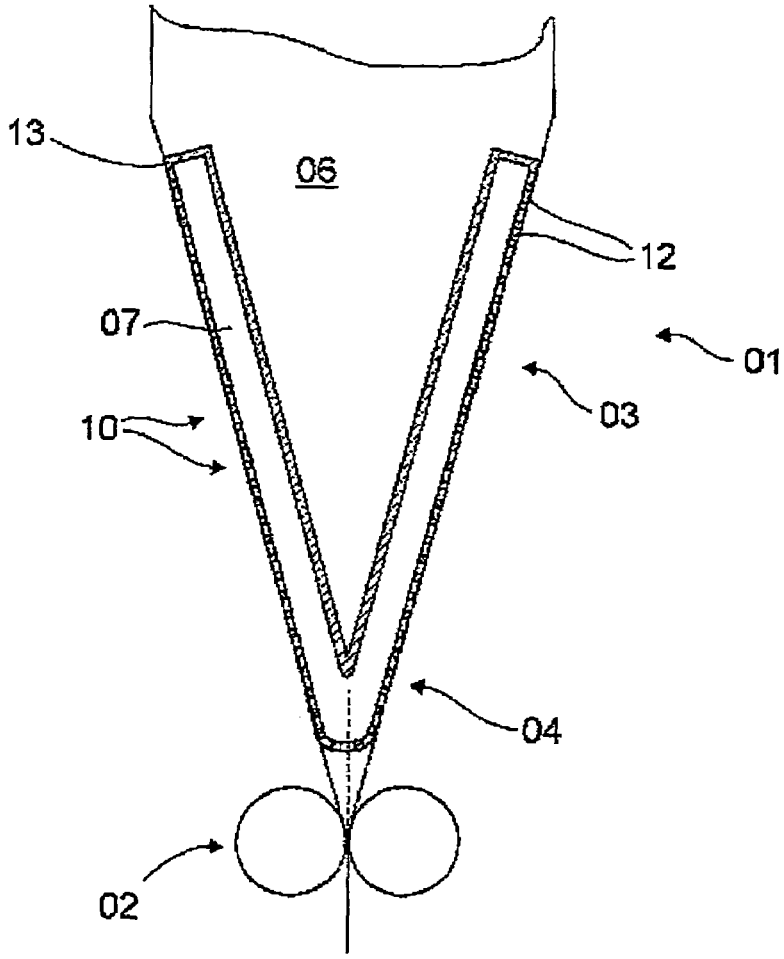

In FIG. 8 the embodiment of the hollow space 07 and the arrangement of micro-bores 10 extending as far as into the nose section 04 is represented in a manner corresponding generally to the embodiment depicted in FIG. 3.

For the embodiment of the micro-openings 10 as openings of bores 12, an excess pressure in the chamber 07 of maximally 2 bar, and in particular of from 0.1 to 1 bar, is of advantage.

Figure 9:
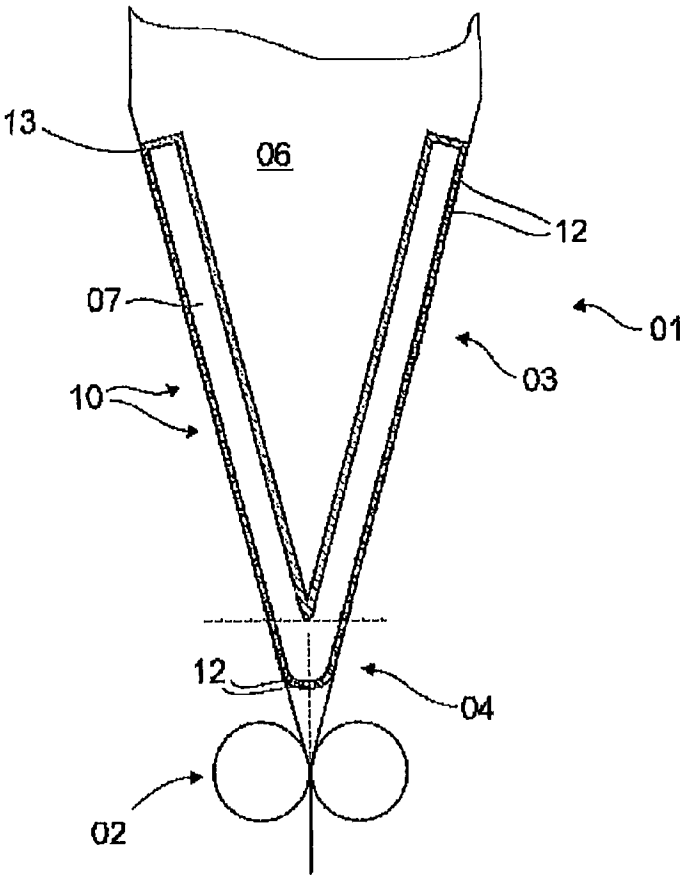

In a structure corresponding generally to FIG. 5, FIG. 9 shows the embodiment of zones of different development of micro-perforations. Thus, for example, the diameter of the micro-bores 12' in the nose section 04, of, for example, 90 to 150 μm, can be larger than that of the micro-bores in the leg area 03 of, for example, 60 to 110 μm. The hole density in the nose section 04 which is greater than 0.3/$mm^2$ can be greater than the hole density in the leg area such as, for example, being greater than 0.2/$mm^2$. Also, instead of, or additionally to this, it is possible to provide different hollow chambers 07, 07' for the nose and for the leg areas, wherein the hollow space 07' assigned to the nose section 04 is charged with a higher excess pressure such as, for example, less than 3 bar, but greater than the excess pressure in the leg area 03 than the pressure in the leg area 03, which is, for example, less than 2 bar, and in particular is less than 1 bar.

The bores 12 can be embodied as being cylindrical, funnel-shaped or in another special shape, such as for example, in the form of a Laval nozzle.

The micro-perforation, used for producing the bores 12, preferably takes place by drilling by the use of accelerated particles, such as for example, a liquid, such as a water jet, such as ions or elementary particles, or by the use of electromagnetic radiation of high energy density, for example as light in the form of a laser beam. Producing such micro-perforations, by the use of an electron beam, is particularly advantageous.

The side of the wall 13 having the bores 12 and facing the web 06, for example a wall 13 which is made of special steel, in a preferred embodiment has a dirt- and/or an ink-repelling finish. Wall 13 has a coating, for example of nickel or advantageously of chromium which is not specifically represented, and which does not cover the micro-openings 10 or the bores 12, and which, for example, has been additionally treated, for example with micro-ribs or has structured in a lotus flower-effect, or preferably is polished to a high gloss.

In a variation of the present invention, the wall 13 with the bores 12 is embodied as an insert or as several inserts positioned in a support. The insert can be connected either fixedly or exchangeably with the support. The exchangeable connection is of advantage with respect to cleaning or with respect to an exchange of inserts with different micro-perforations, which is beneficial for matching different inks, printing formats, and the like.

Figure 10:
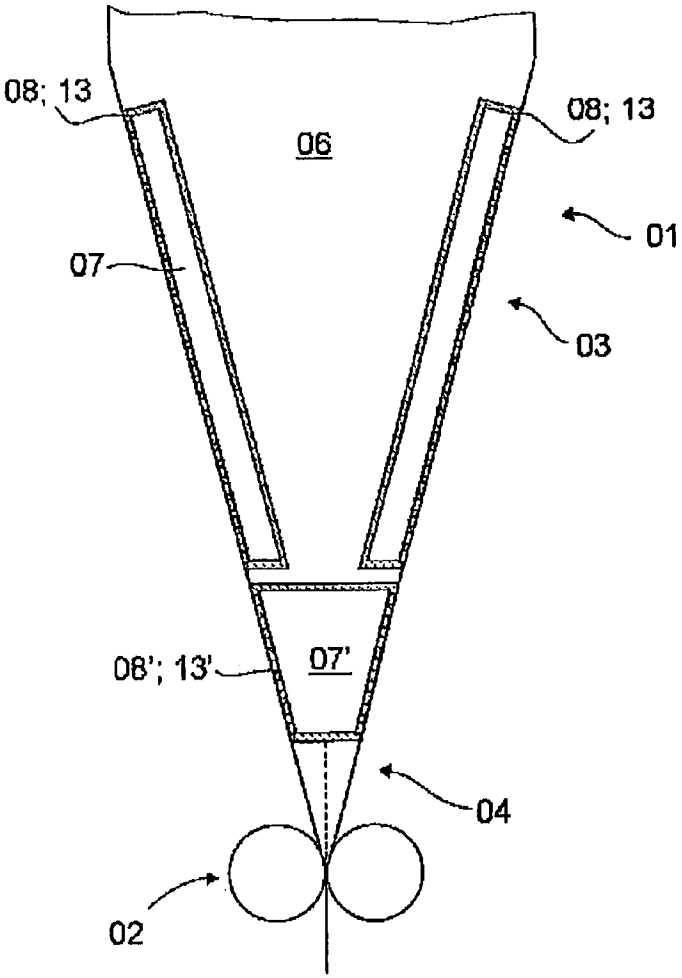

FIG. 10 shows a basic sketch of a further embodiment of the former 01 of the present invention, wherein the leg areas 03 are constituted by the tubes or spars 08 and the nose section 04 by its own support 08' or by a support body 08' forming a hollow space 07'. In FIG. 10 the micro-porous, air permeable layer 09 is not represented in the leg and nose areas 03, 04. Since this embodiment form of the invention is to be applied, in the same way, to the preferred embodiment with the micro-bores 12, the components were correspondingly identified for both embodiments. The leg areas 03 then have the wall 13, and the nose section 04 has the chamber wall 13'.

In an embodiment of the present invention which is not specifically represented, the upper element supporting the leg areas 03 can also be embodied as a double-walled hollow body which has the bores 15 and the layer 09, or the micro-bores 12 in the leg area 03 and possibly also in the triangularly-shaped area lying inbetween.

Figure 11:
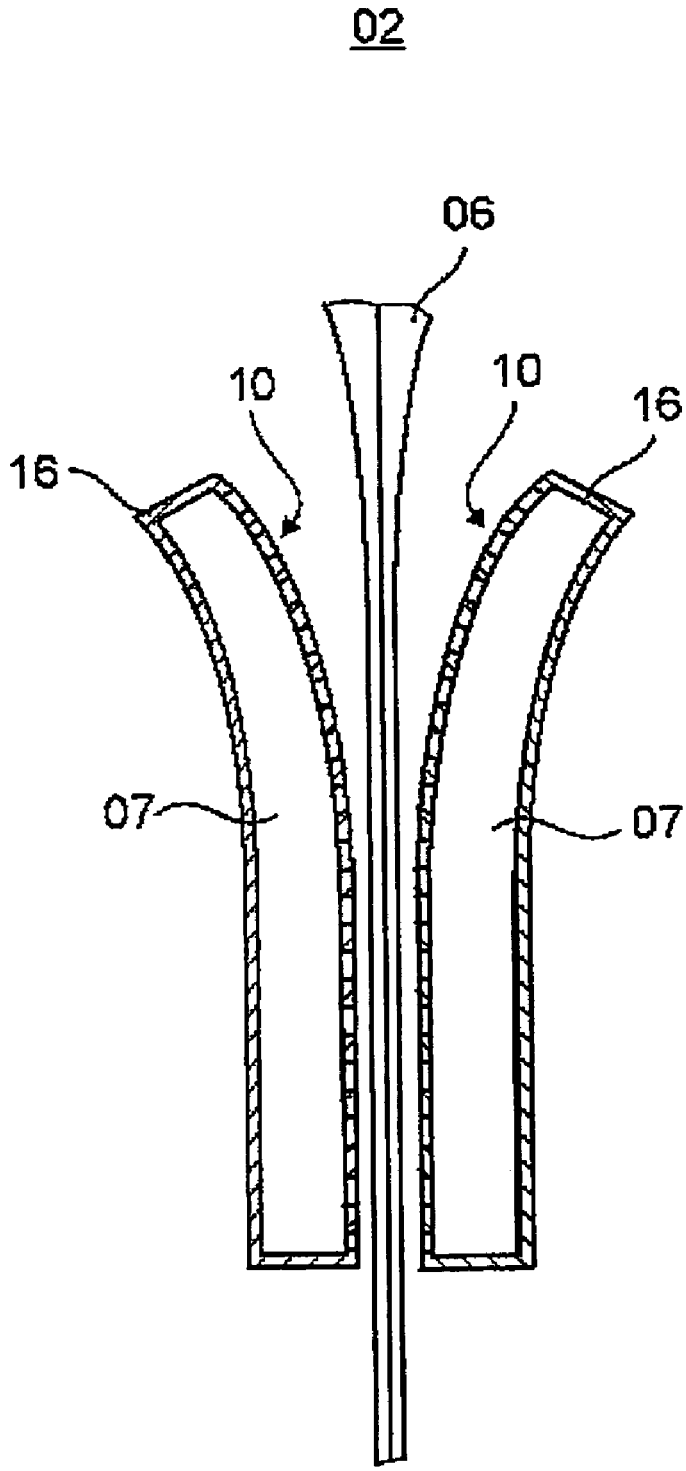

In a further development of the present invention, as seen in FIG. 11, the traction roller pair 02 making the fold is not embodied as a pair of rotatable rollers, but instead is embodied as a folding device 02 with two oppositely located surfaces, which surfaces have micro-openings 10 on their sides facing the web 06, or the strand. These folding surfaces, with the micro-openings 10 can be arranged on a common support body 16 enclosing a common hollow chamber 07, on a common support body 16 enclosing two separate hollow spaces 07, or on two separate support bodies 16, each of which has a hollow space 07. In one of the three above-described configurations, the micro-openings 10 are embodied as open pores in a porous material 09 or as openings of micro-pores 10 and can be charged from the hollow space 07 with compressed air. In one case, a layer 09, together with bores 15, has been applied to the inside of the support body 07, in the other case this side has micro-bores 12. The web 06 or the strand is passed between the surfaces facing each other and is provided with its linear or its back fold. For this purpose, the distance between the folding surfaces tapers, for example, in the direction of the running web 06.

The folding device 02 can be advantageously embodied, in addition to one of the above-described formers 01 having micro-openings 10, or the folding device 02 can be constructed independently of the embodiment of the former 01, in the configuration described above.

While preferred embodiments of a former for web-producing or web-processing machines, in accordance with the present invention have been set forth fully and completely hereinabove, it will be apparent to one of skill in the art that various changes in, for example, the overall size of the former, the source of supply of the compressed air and the like could be made without departing from the true spirit and scope of the present invention which is accordingly to be limited only by the appended claims.

What is claimed is:

1. A longitudinal former of a web-processing machine comprising:

a longitudinal web former support body adapted to form a longitudinal fold in a continuous web moving in a web travel direction over said web former support body;

first and second leg areas of said web former support body, said first and second leg areas each extending generally in said web travel direction, each having a rigid, air permeable leg area support surface, both said first and second leg areas being adapted to concurrently engage the web being longitudinally folded during travel of the web over said web former support body, said first and second leg areas of said web former support body converging in said web travel direction with respect to each other, and at an acute angle;

a nose section of said web former support body, said nose section of said web former support body being located at a convergence of said first and second converging leg areas of said web former support body, said nose section of said web former support body having a rigid, air permeable nose support surface adapted to engage the web being longitudinally formed by said web former support body, said nose section defining a longitudinal fold to be imparted to the web moving over said web former support body;

a first surface layer of a micro-porous air permeable material on said support surfaces of each of said first and second converging leg areas of said web former support body, said first surface layer having a plurality of micro-openings of open pores of said micro-porous, air permeable material for the exit of a fluid under pressure and with a mean diameter of less than 150 μm, said first surface layer providing a first fluid output between said leg support surfaces and the web moving over said web former support body and having a first fluid permeability per unit of area; and a second surface layer of a micro-porous, air permeable material on said nose support surface of said nose section of said web former support body, said second surface layer having a plurality of micro-openings of open pores of said micro-porous material for the exit of fluid under pressure and with a mean diameter of less than 150 μm, said second surface layer providing a second fluid output, greater than said first fluid output, between said nose support surface and the web moving over said web former support body, and having a second fluid permeability per unit of area, said second fluid permeability being greater than said first fluid permeability.

2. The former of claim 1 wherein said pores have a mean diameter of 5 to 50 μm.

3. The former of claim 1 wherein said micro-porous, air permeable material is an open-pored sinter material.

4. The former of claim 1 wherein said micro-porous, air permeable material is an open-pored sinter metal.

5. The former of claim 1 wherein said web former support body is load bearing and encloses a hollow space, said first and second layers being supported by said support body.

6. The former of claim 5 wherein said web former support body connected with said first and second surface layers has a plurality of openings adapted to supply fluid to said first and second surface layers.

7. The former of claim 6 wherein said first and second surface layers have a thickness between 0.05 mm and 0.3 mm.

8. The former of claim 5 wherein said web former support body has a plurality of passages.

9. The former of claim 5 wherein said web former support body has a wall supporting said first and second surface layers, said wall having a wall thickness of greater than 3 mm.

10. The former of claim 5 wherein said web former support body is a porous material having an air permeability greater than said micro-porous, air permeable material.

11. The former of claim 5 wherein said web former support body includes a flat material including said hollow space.

12. The former of claim 5 wherein in each of said first and second angularly converging leg areas, said web former support body is a tube provided with passages.

13. The former of claim 1 wherein said micro-openings allow passage of 1 to 20 standard cubic meters of air per hour.

14. The former of claim 1 wherein said micro-porous, air permeable material is charged with an excess pressure of at least 1 bar.

15. The former of claim 1 wherein said micro-porous, air permeable material is charged with an excess pressure of at least 4 bar.

16. The former of claim 1 further including a feed line adapted to feed fluid to said web former support body, said feed line having an interior area of less than 100 $mm^2$.

17. The former of claim 1 wherein said micro-openings are formed in an insert which is releasably secured to said web former support body.

18. The former of claim 1 further including a first hollow chamber adapted to supply said first and second leg areas of said web former support body with fluid and a second hollow chamber adapted to supply said nose section of said web former support body with fluid.

19. The former of claim 18 wherein a pressure in said first hollow chamber is different from a pressure in said second hollow chamber.

20. The former of claim 1 wherein an air exit rate in each of said first and second leg areas is between 2 to 15 standard cubic meters per $m^2$ and an air exit role in said nose section is between 7 and 20 standard cubic meters per $m^2$ and further wherein said nose section air exit rate is greater than each said first and second leg area air exit rate.

* * * * *